US005971344A

United States Patent [19]

Ainsworth

[11] Patent Number: 5,971,344

[45] Date of Patent: Oct. 26, 1999

[54] METHOD OF USING AN OPEN BOOK SECURING DEVICE FOR HANDS-FREE READING OF AN OPEN BOOK

[76] Inventor: David V. Ainsworth, 364 Lombard St., San Francisco, Calif. 94133

[21] Appl. No.: 09/137,092

[22] Filed: Aug. 20, 1998

[51] Int. Cl.[6] ..... A47B 23/00

[52] U.S. Cl. ..... 248/445; 248/452; 248/453; 248/458

[58] Field of Search ..... 248/452, 441.1, 248/445, 447, 448, 450, 451, 453, 454, 455, 458

[56] References Cited

U.S. PATENT DOCUMENTS

| | | | |
|---|---|---|---|
| 1,564,113 | 12/1925 | Rauhofer | 248/451 |
| 1,692,337 | 11/1928 | Forbes | 248/445 |
| 4,043,530 | 8/1977 | May | 248/453 |
| 4,163,539 | 8/1979 | Awofolu | 248/452 |
| 4,165,856 | 8/1979 | Wiseheart | 248/458 X |
| 5,375,806 | 12/1994 | Debus et al. | 248/452 |
| 5,615,856 | 4/1997 | Simington | 248/452 |

*Primary Examiner*—Ramon O. Ramirez
*Assistant Examiner*—Stephen S. Wentsler

[57] ABSTRACT

A platform assembly is provided with a raised edge at the bottom against which a bottom edge of the open book rests. A securing device is provided with a bar with a hook at each end of the bar, first and second prongs extending downwardly from the lower side of the bar, first and second shafts mounted to the front side of the bar, and first and second restraining wheels secured to a corresponding one of the shafts by opposing springs mounted to each of the shafts. The securing device is installed on the platform by sliding the hooks over the upper side edges of the platform. The prongs of the securing device are positioned over inner sides of the front and back covers of an open book to secure the book to the platform assembly. The open book is positioned such that rounded tabs of the platform assembly and the restraining wheels of the securing device maintain the pages of the book in an open orientation. A selected page of the open book is turned by applying manual pressure with one or more fingers in a direction of the turn such that the selected page slides free from a first restraining wheel and a first rounded tab. The selected page is then positioned behind the second restraining wheel and the second rounded tab.

6 Claims, 3 Drawing Sheets

12
15
16
16
14
13
11
21
13
15
16
14
16
12

15
14
13
11
13
15
14

METHOD OF USING AN OPEN BOOK SECURING DEVICE FOR HANDS-FREE READING OF AN OPEN BOOK

SUMMARY OF THE INVENTION

The invention is an open book securing device. It cannot be used as a stand-alone apparatus, but must be used in connection with a stand assembly, consisting of (i) a base, with or without rollers, (ii) a vertical column, which may or may not be adjustable, projecting upward from the base, (iii) a horizontal arm, which may or may not be adjustable, at the top of and supported by the vertical column, (iv) a platform which is secured to and rotates up to 180 degrees around the horizontal arm, and (v) a raised edge at the bottom of the platform with rounded tabs extending from the raised edge toward the top of and parallel to the face of the platform.

The invention is designed to be positioned on the upper side of the platform (opposite side from the raised edge) by sliding the hooks on either side of the invention over the upper sides of the platform. The prongs projecting downward from the invention and parallel to the platform slide over the inside of the front and back covers of an open book, thus securing the book to the platform. The pages to which the book is opened are positioned behind wheels, which may or may not be flexible and/or adjustable, and which are mounted on a shaft projecting vertically from the invention and perpendicular to the face of the platform when the invention is mounted on it.

With a book thus secured, the platform may be rotated and secured at any position from the horizontal, face-up, through the vertical, to the horizontal, face-down. The invention, when used in connection with prior art comprising the stand assembly as described, uniquely permits a hands-free reading of a book within a broad range of eye focus positions by a reader in virtually any sitting or face-up inclining or lying position. Moreover, the device permits the pages of the book to be turned in either direction in a conventional manner with the fingers of one hand.

DETAILED DESCRIPTION

Figure 1:
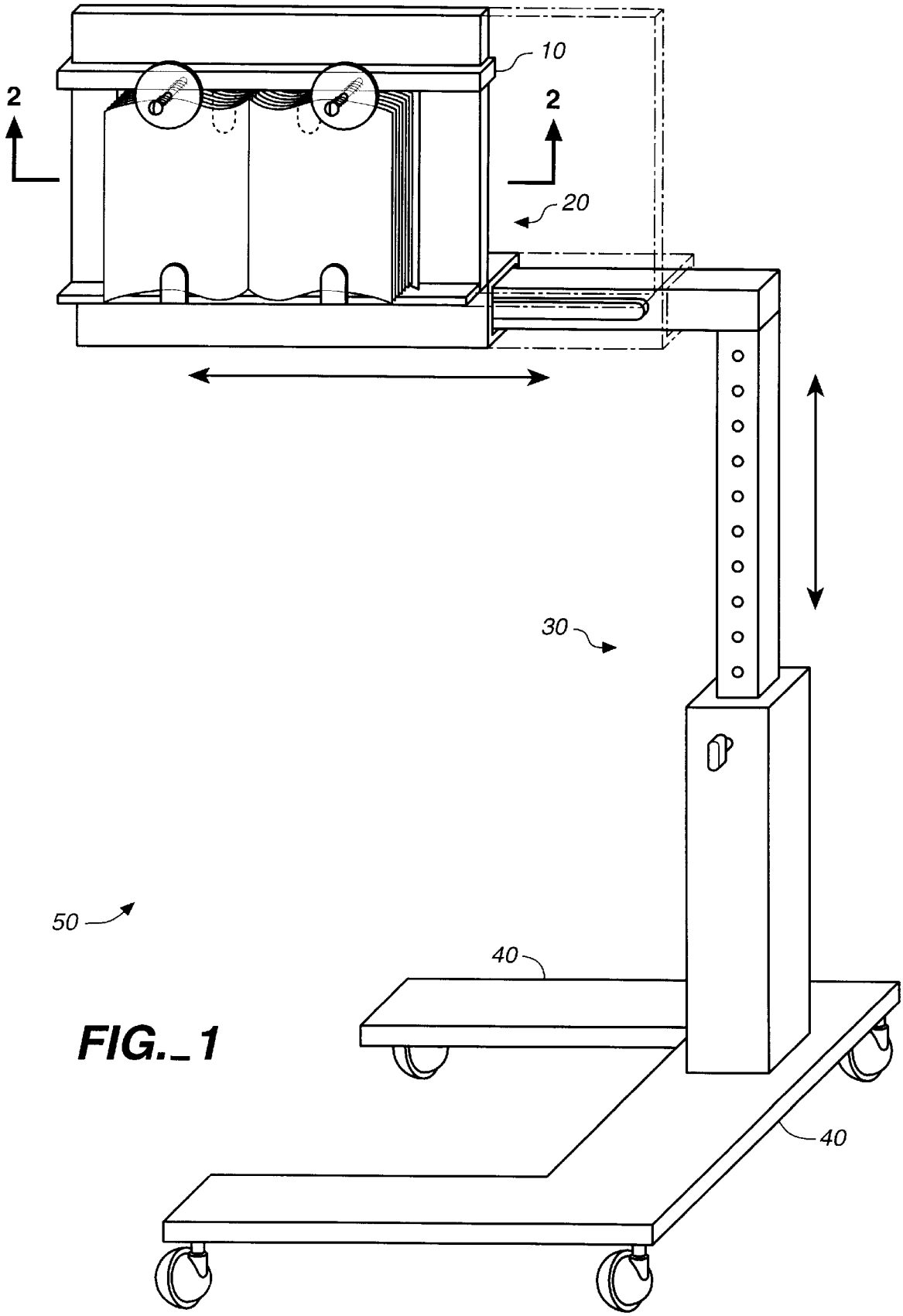
FIG. 1 is a perspective view of the invention mounted on the carrying stand assembly, showing the embodiment of the method of holding an open book in a range of positions relative to a reader.

Referring to FIG. 1, there is illustrated an open book securing device 10 (the "invention"). The purpose of the invention is to provide a hands-free method, when used in connection with a stand assembly 50, of holding an open book within a range of comfortable eye focus areas for persons sitting, inclined, or lying down, face-up. The further purpose of the invention is to permit a page of the book so secured to be readily turned, forward or backward, in a conventional manner with the fingers of one hand.

Figure 4:
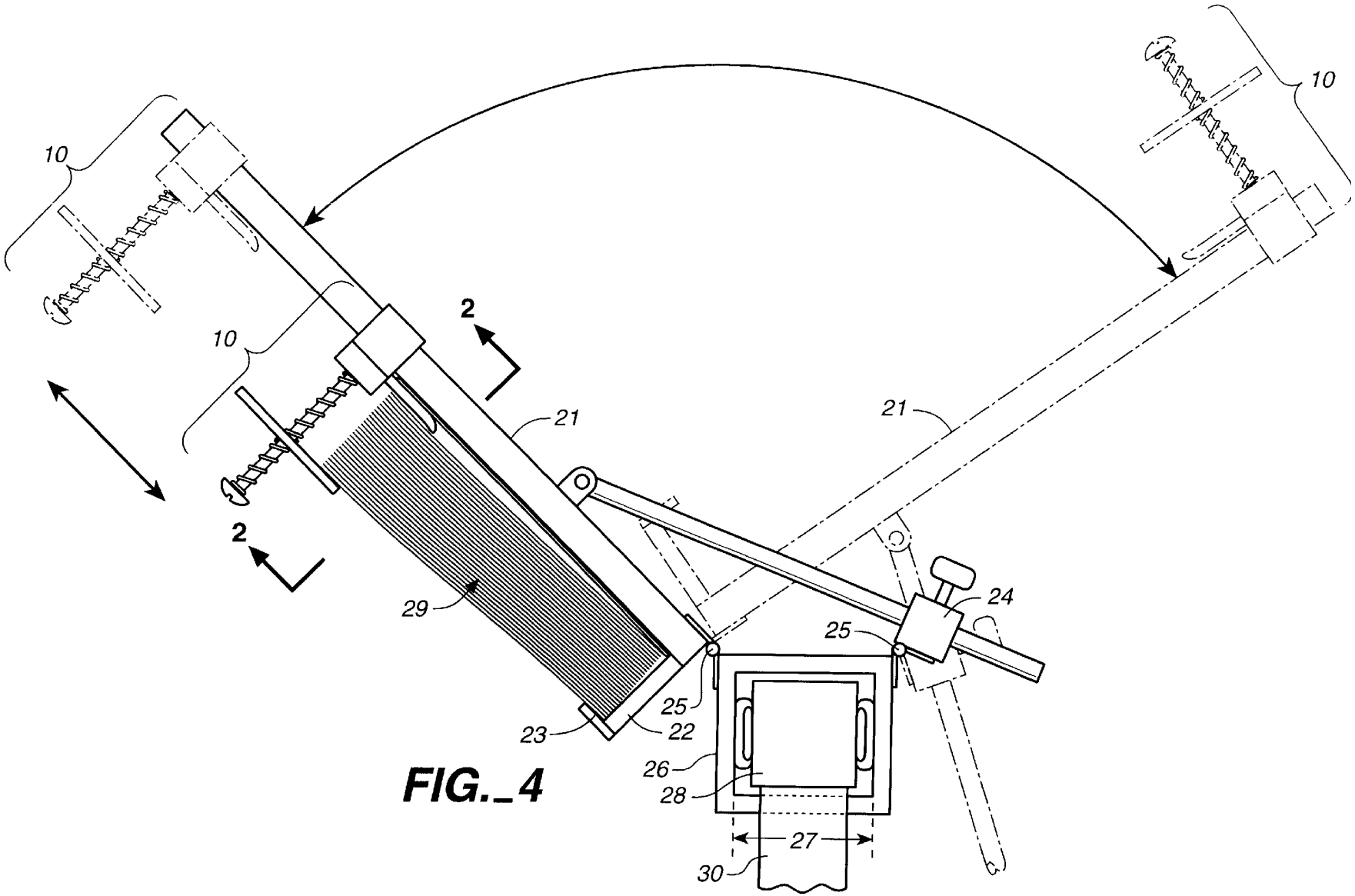
FIG. 4 is a right side elevational view of the invention mounted on the rotating platform assembly in the preferred embodiment of the method of this invention in holding an open book, hands-free, within a 180 degree range of positions from the horizontal face-up through the horizontal, face-down.

In order to accomplish these purposes, the open book securing device 10 must be used in connection with methods and apparatus' which are prior art, namely a stand assembly 50 consisting of a base 40, with or without rollers, a vertical column 30 secured to and projecting upward from the base 40, with or without a telescoping or sliding construction, making the height of the column adjustable, a horizontal arm 28 (FIG. 4) secured to the upper end of the vertical column 30, which arm 28 may or many not be of a telescoping or sliding construction, making the length of the arm adjustable; and a hinged 25 platform assembly 20 attached to the horizontal arm 28, which platform assembly rotates around the horizontal arm 28 up to 180 degrees, that is, from face-up through face-down, all as illustrated in FIGS. 1 and 4. The platform will have a raised edge 22 at the bottom (lower edge when the platform is inclined). The raised edge at the bottom of the platform will have secured to it two rounded tabs 23—one on each side approximately one third of the distance from the sides of the platform—projecting toward the top edge of the platform face 21 and parallel to it (to restrain the lower edges of the pages of an open book placed on the platform and resting against the raised edge 22 on which the tabs 23 are mounted.) Refer to FIG. 4 for an illustration of the platform assembly with which the invention is used.

Figure 2:
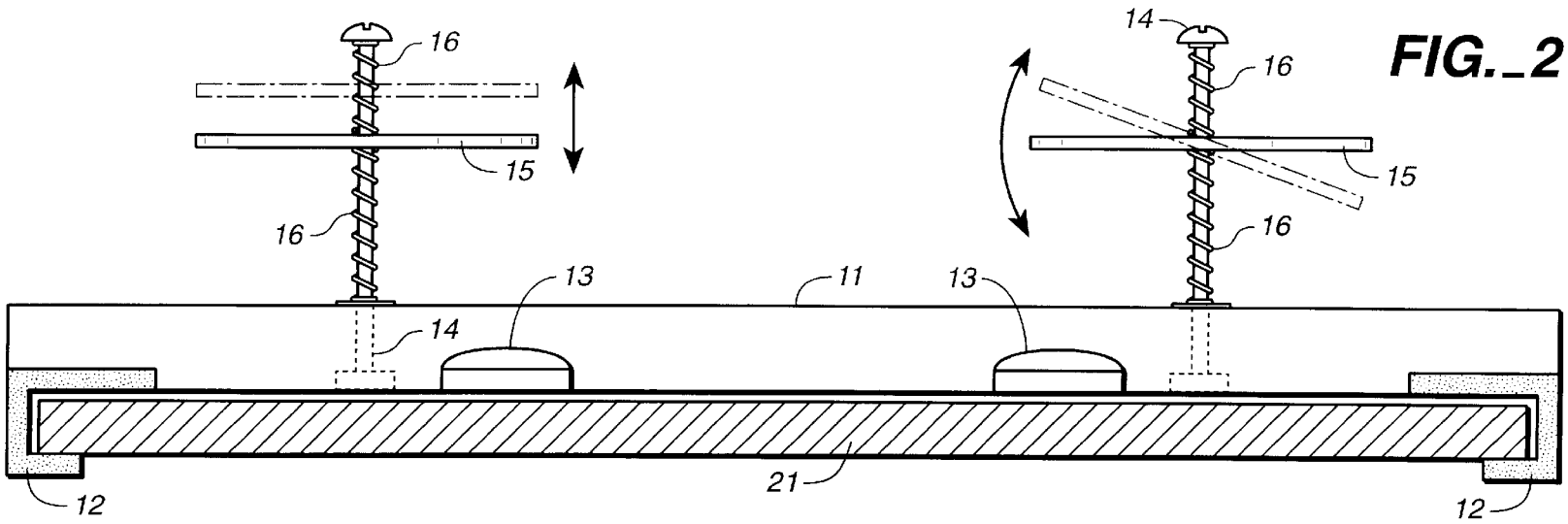
FIG. 2 is a bottom plan, cross-sectional view of the invention, showing the invention mounted on the face of the rotating platform of the stand assembly with the flexible, spring-loaded wheels positioned on the shaft projecting from the front side.
Figure 3:
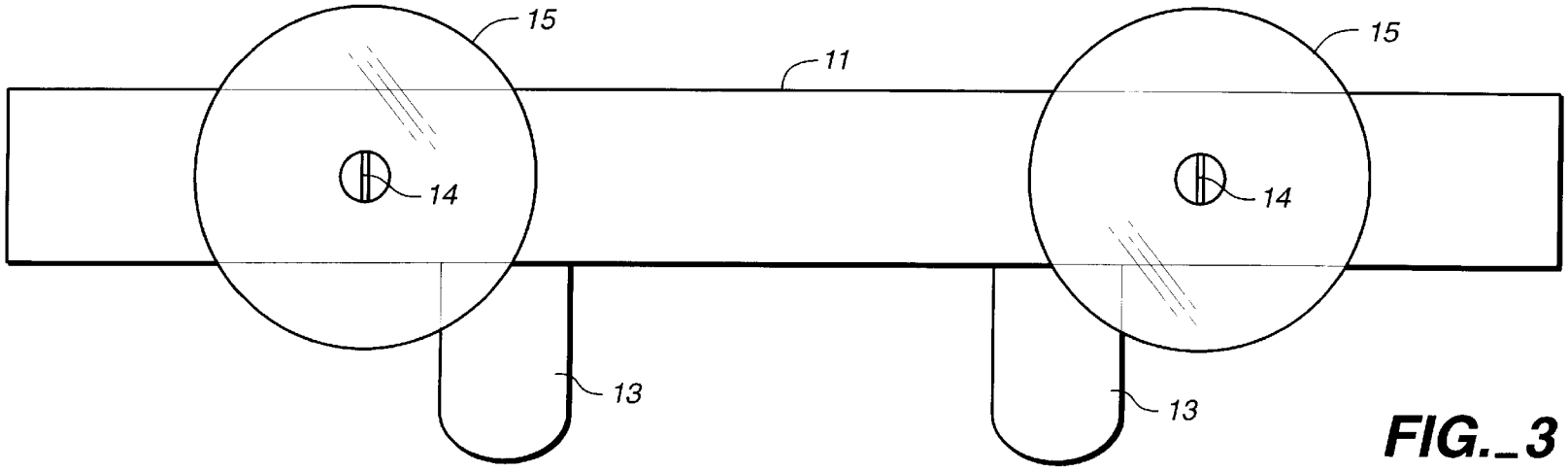
FIG. 3 is a front elevational view of the invention, showing the face of the page-restraining wheels as well as the prongs projecting from the bottom of the invention to grip the inside front and rear covers of a book.

The open book securing device 10 consists of a bar 11 on which two hooks 12, two prongs 13, and two shaft-mounted wheel 15 arrangements are mounted. The bar 11 has at least one flat side on each end of which a hook 12 is affixed with the hooks facing each other along the flat side of the bar 11. See FIG. 2. The bar is long enough to span an open book from side-to-side, but is in any event sized so that the hooks facing toward each other will fit over the edges of the platform 21, permitting the flat side of the bar 11 to slide along the face of the platform 21 but the bar remains secured to the platform by the hooks 12. The prongs 13 are mounted on and recessed into the flat face of the bar 11 approximately one third of the distance from each end of the bar 11. Each prong 13 will extend downward and parallel to the flat side of the bar 11. See FIGS. 2,3 4.

Approximately the same distance from the end of the bar 11 as, but offset slightly from, the prongs 13, there is a shaft 14 installed perpendicular to the flat side on the bar 11 and running through the bar. A wheel 15, which is secured by opposing springs 16 mounted on the shaft 14 which serves as the axis for the wheel 15. The flat side of each wheel 15 is secured up to approximately 2 inches from the surface of the platform 21. See FIG. 2. The radius of the wheels 15 is greater than the width of the bar 11 through which the shaft assembly passes. This permits the page to which the book is opened to be restrained behind the wheels on the invention when the bar is resting against the top edge of the book. Refer to FIG. 4.

The open book securing device 10 thus assembled is installed on the platform 21 of the stand assembly 50 described above with the hooks on either end of the bar 11 sliding over the upper side edges of the platform face 21. So installed, the invention permits an open book 29 to be placed on the platform below the invention with the prongs 13 of the invention sliding down over the inside of the front and back covers of the book 29 until the bar 11 touches the book, thus securing the open book 29 to the platform assembly 20.

The pages to which the book 29 is opened are then restrained by placing the upper edge of each open page behind the corresponding wheel 15 on the invention and the lower edge of each open page behind the corresponding rounded tab 23 fixed to the raised edge on the bottom of the platform 21. Refer to FIG. 4.

Referring to FIG. 4, the book is thereby held securely to the platform assembly 20 and the pages are thereby held open as the platform assembly 20 is rotated 180 degrees between the horizontal face-up through the horizontal, face-down. The pages of the book, regardless of the inclination of the platform onto which the invention is mounted through its 180 degree arc will remain open and may be turned sequentially in either direction by a conventional movement of the fingers of one hand. That is, the page to be turned is held at its edge and pushed toward the other side of the book. The force of the push causes the turning page to slip free of the restraining lower rounded tab 23 fixed to the raised edge 22 at the bottom of the platform 21 and the wheel 15 on the invention restraining the top of the turning page. The turning motion continues with the hand and is completed by pushing the upper and lower edges of the turned page behind the restraining wheel 15 and tab 23 on the opposing side, after which the book will remain open, hand-free, at the new page setting.

The platform assembly 20 is secured to the channel box 26 by means of hinges 25 and a hinged locking arm 24 mounted on a box channel 26 which is, in turn, secured to the horizontal arm 28 by slides 27 installed on the inside of the box channel 26 and on the horizontal arm 28. Refer to FIG. 4. The channel box 26 with mounted slides 27 is constructed to fit securely over the horizontal arm 28. This permits the weight of the platform assembly 20, together with the weight of a book mounted on the platform assembly 29 restrained by the open book securing device 10, including at times when the platform assembly and book are positioned on one side of the horizontal arm 28, to slide freely, overcoming the torque of the off-center platform assembly and book

I claim:

1. A method of using an open book securing device for hands free reading of an open book, comprising the steps of:

(a) providing a stand assembly including a base, a vertical column attached to and projecting upward from the base, a horizontal arm attached at a top of the vertical column, and a platform assembly secured to the horizontal arm, the platform assembly including a front surface, a lower side, a raised edge extending from the lower side of the platform assembly, and first and second rounded tabs on the raised edge, wherein the platform assembly is capable of rotating to a reading position along an arc up to 180 degrees around an axis defined by the horizontal arm from a horizontal position wherein the front surface of the platform assembly faces in an upward direction, to a vertical position wherein the front surface of the platform assembly faces a reader, to another horizontal position wherein the front surface of the platform assembly faces in a downward direction, (b) providing the device, the device comprising a bar including a first end, a second end, a flat back side, a front side, and a lower side, the device further comprising a first end hook on the first end of the bar, a second end hook on the second end of the bar, prongs extending downwardly from the lower side of the bar, a first shaft mounted to the front side of the bar and extending outwardly from the front side of the bar, a second shaft mounted to the front side of the bar and extending outwardly from the front side of the bar, a first restraining wheel mounted on the first shaft and secured by opposing springs mounted on the first shaft, a second restraining wheel mounted on the second shaft and secured by opposing springs mounted on the second shaft, the first shaft defining a first axis for the first restraining wheel, and the second shaft defining a second axis for the second restraining wheel, (c) installing the device on the platform assembly by sliding the first end hook and second end hook over upper side edges of the platform assembly with the flat back side of the bar positioned against the front surface of the platform assembly, (d) placing the open book on the platform assembly in a face-up orientation with the device positioned at a top of the book and a lower edge of the book resting on the raised edge of the platform assembly, (e) sliding each of the prongs over inner sides of a corresponding one of a front and back cover of the open book to secure the front and back covers of the book to the platform assembly, (f) positioning the upper edge of at least one opened page of the book behind the first restraining wheel and the lower edge of the at least one opened page behind the first rounded tab such that a flat side of the first restraining wheel is parallel to a plane of a first opened page, positioning the upper edge of at least a second opened page of the book behind the second restraining wheel and the lower edge of the at least second opened page behind the second rounded tab such that a flat side of the second restraining wheel is parallel to a plane of a second opened page, (g) rotating the platform assembly to a reading position along the arc, (h) turning the first opened page of the book by applying one or more fingers of one hand to the top or side of the first opened page, applying manual pressure with the one or more fingers in a direction of the turn such that the first opened page slides free from the first restraining wheel and the first rounded tab, and positioning the first opened page behind the second restraining wheel and the second rounded tab.

2. The method of using an open book securing device for hands free reading of an open book as defined in claim 1, comprising the further steps of providing the base of the stand assembly with rollers.

3. The method of using an open book securing device for hands free reading of an open book as defined in claim 1, comprising the further steps of providing the vertical column of the stand assembly with a telescoping construction for vertical positioning of the platform assembly.

4. The method of using an open book securing device for hands free reading of an open book as defined in claim 1, comprising the further steps of providing the vertical column of the stand assembly with a sliding construction for vertical positioning of the platform assembly.

5. The method of using an open book securing device for hands free reading of an open book as defined in claim 1, comprising the further steps of providing the horizontal arm of the stand assembly with a telescoping construction for horizontal positioning of the platform assembly.

6. The method of using an open book securing device for hands free reading of an open book as defined in claim 1, comprising the further steps of providing the horizontal arm of the stand assembly with a sliding construction for horizontal positioning of the platform assembly.

* * * * *